US009242345B2

(12) United States Patent
Roy et al.

(10) Patent No.: US 9,242,345 B2
(45) Date of Patent: Jan. 26, 2016

(54) ABRASIVE TOOLS AND METHODS OF FORMING THE SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Debdutta Roy, Kolkata (IN); Srinivasan Ramanath, Holden, MA (US); John Tunstall, Buffalo Grove, IL (US); Rachana Upadhyay, Shrewsbury, MA (US); Arup K. Khaund, Northborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 14/303,348

(22) Filed: Jun. 12, 2014

(65) Prior Publication Data

US 2014/0366457 A1 Dec. 18, 2014

Related U.S. Application Data

(60) Provisional application No. 61/835,566, filed on Jun. 15, 2013.

(51) Int. Cl.

| | |
|---|---|
| ***B24D 3/02*** | (2006.01) |
| ***B24D 3/06*** | (2006.01) |
| ***B24D 5/00*** | (2006.01) |

(52) U.S. Cl.
CPC ..... *B24D 3/06* (2013.01)

(58) Field of Classification Search
CPC ..... B24D 3/02; B24D 3/06; B24D 5/00
See application file for complete search history.

(56) References Cited

U.S. PATENT DOCUMENTS

| | | | |
|---|---|---|---|
| 4,655,795 | A | 4/1987 | Bleecker et al. |
| 5,129,918 | A | 7/1992 | Chattopadhay |
| 5,385,591 | A | 1/1995 | Ramanath et al. |
| 6,358,133 | B1 | 3/2002 | Cesena et al. |
| 2007/0037501 | A1 | 2/2007 | Buljan et al. |
| 2009/0017736 | A1 | 1/2009 | Block et al. |
| 2009/0151267 | A1 | 6/2009 | Upadhyay et al. |
| 2012/0066982 | A1 | 3/2012 | Ramanath et al. |
| 2012/0137596 | A1 | 6/2012 | Ujihashi et al. |

*Primary Examiner* — Pegah Parvini

(74) *Attorney, Agent, or Firm* — Abel Law Group, LLP; Joseph P Sullivan

(57) ABSTRACT

An abrasive tool is provided that may include a body, which may include abrasive particles contained within a bond material. The abrasive particles may be a super abrasive material. The body may further include at least one of a ratio of tungsten to cast iron (W/CI) of not greater than about 1, a ratio of copper-containing compositions to cast iron (CCC/CI) of not greater than about 1, a ratio of titanium-containing compositions to cast-iron (TiCC/CI) of not greater than about 1, a ratio of tungsten carbide to cast iron (WC/CI) of not greater than about 1, a ratio of tungsten carbide to copper-containing compositions (WC/CCC) of not greater than about 1, a ratio of copper-containing compositions and titanium-containing compositions to cast iron ((CCC+TiC)/CI) of not greater than about 1.5 or a combination thereof.

20 Claims, 1 Drawing Sheet

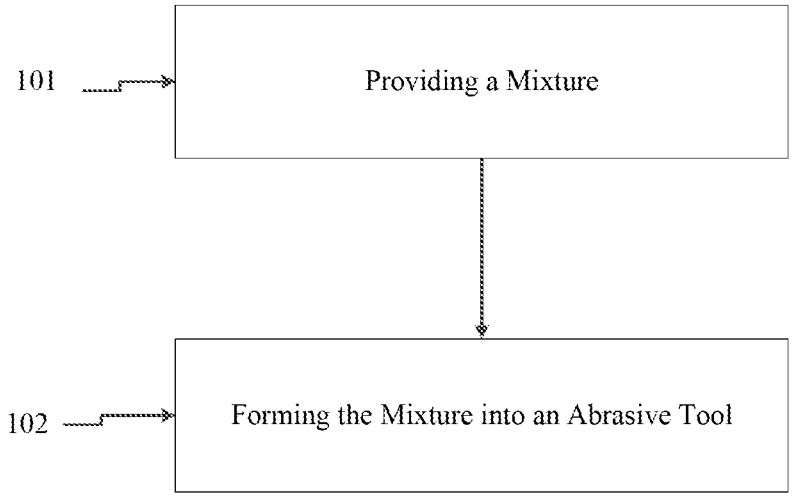
101
Providing a Mixture
102
Forming the Mixture into an Abrasive Tool

ABRASIVE TOOLS AND METHODS OF FORMING THE SAME

CROSS-REFERENCE TO RELATED APPLICATION(S)

The present application claims priority from U.S. Provisional Patent Application No. 61/835,566, filed Jun. 15, 2013, entitled "ABRASIVE TOOLS AND METHODS OF FORMING THE SAME," naming inventors Debdutta Roy, Srinivasan Ramanath, John Tunstall, Rachana Upadhyay, and Arup K. Khaund, and said provisional application is incorporated by reference herein in its entirety for all purposes.

BACKGROUND

1. Field of the Disclosure

The following is directed to an abrasive tool, and more particularly, an abrasive tool including abrasive particles and a bond material.

2. Description of the Related Art

Abrasive tools used in machining applications typically include bonded abrasive articles and coated abrasive articles. Coated abrasive articles are generally layered articles having a backing and an adhesive coat to fix abrasive particles to the backing, the most common example of which is sandpaper. Bonded abrasive articles consist of rigid, and typically monolithic, three-dimensional, abrasive composites in the form of wheels, discs, segments, mounted points, hones and other article shapes, which can be mounted onto a machining apparatus, such as a grinding, polishing or cutting apparatus. Some bonded abrasive articles may be particularly useful in grinding, shaping or cutting certain types of workpieces, including for example, glass materials.

Accordingly, the industry continues to demand improved bonded abrasive articles and methods for their use.

SUMMARY

According to a first aspect, an abrasive tool may include a body, which may include abrasive particles contained within a bond material. The abrasive particles may be a superabrasive material. The body may further include an active bonding agent contained within the bond material. The active bonding agent may be a titanium-containing composition. The body may further include at least one of a ratio of tungsten to cast iron (W/CI) of not greater than about 1, a ratio of copper-containing compositions to cast iron (CCC/CI) of not greater than about 1, a ratio of titanium-containing compositions to cast-iron (TiCC/CI) of not greater than about 1, a ratio of tungsten carbide to cast iron (WC/CI) of not greater than about 1, a ratio of tungsten carbide to copper-containing compositions (WC/CCC) of not greater than about 1, a ratio of copper-containing compositions and titanium-containing compositions to cast iron ((CCC+TiC)/CI) of not greater than about 1.5 or a combination thereof.

According to another aspect, an abrasive tool may include a body, which may include abrasive particles contained within a bond material. The abrasive particles may be a superabrasive material. The body may further include at least one high material removal rate characteristic selected from the group consisting of a break-in length of not greater than about 1000 linear meters of a workpiece, a maximum initial speed character of at least about 10 m/min, a life span of at least about 1000 linear meters of a workpiece, a dressing frequency of at least about 25 parts/dress, an edge quality of at least about 25% or a combination thereof.

According to yet another aspect, a method for forming an abrasive tool configured to grind glass may include providing a mixture, which may include a bond material, abrasive particles and an active bonding agent. The abrasive particles may be a superabrasive material. The active bonding agent may be a titanium-containing composition. The mixture may further include at least one of a ratio of tungsten to cast iron (W/CI) of not greater than about 1, a ratio of copper-containing compositions to cast iron (CCC/CI) of not greater than about 1, a ratio of titanium-containing compositions to cast-iron (TiCC/CI) of not greater than about 1, a ratio of tungsten carbide to cast iron (WC/CI) of not greater than about 1, a ratio of tungsten carbide to copper-containing compositions (WC/CCC) of not greater than about 1, a ratio of copper-containing compositions and titanium-containing compositions to cast iron ((CCC+TiC)/CI) of not greater than about 1.5 or a combination thereof. The method may further include forming the mixture into an abrasive tool.

BRIEF DESCRIPTION OF THE DRAWINGS

The present disclosure may be better understood, and its numerous features and advantages made apparent to those skilled in the art by referencing the accompanying drawings.

FIG. 1 includes a flow chart illustrating a process for forming an abrasive tool according to one embodiment.

The use of the same reference symbols in different drawings indicates similar or identical items.

DETAILED DESCRIPTION

Abrasive tools and techniques are disclosed that can be used for high speed grinding, including for example, high speed grinding of various workpieces, such as ceramics and glass. In particular, the abrasive tools may be used in the high speed grinding of automotive glass, which have been demonstrated to have improved performance, life, and efficiency over conventional grinding tools. The abrasive tool may include abrasive particles within a bond material.

In more detail, embodiments of abrasive tools described herein may include abrasive particles within a bond material. The bond material may include a metal bond material, an active bonding agent, fillers or a combination thereof. In certain embodiments, the metal bond material may be a copper-containing composition. A copper-containing composition may be defined as any material, alloy, chemical composition or elemental compound that includes a copper component. The active bonding agent may be a titanium-containing composition. A titanium-containing composition may be defined as any material, alloy, chemical composition or elemental compound that includes titanium. The fillers may include cast iron.

FIG. 1 includes a flow chart illustrating a method of forming an abrasive article in accordance with embodiments described herein. As illustrated in FIG. 1, a process 100 can be initiated at step 101 by providing a mixture containing abrasive particles and unprocessed bond material. The unprocessed bond material may include unprocessed metal bond material, an unprocessed active bonding agent, unprocessed fillers or a combination thereof. In certain embodiments, the unprocessed metal bond material may be a copper-containing composition. The unprocessed active bonding agent may be a titanium-containing composition. The unprocessed fillers may include cast iron. Reference herein to unprocessed materials, is reference to starting materials, which may not necessarily undergo a chemical or physical change during processing. However, it will be appreciated that certain unprocessed components may undergo a chemical or physical change during formation of the abrasive tool.

The unprocessed bond material may be in the form of a bond powder. The unprocessed bond particles in the bond powder may have an average diameter, for instance, of not more than 40 microns or even 30 microns or less.

The abrasive particles can include an inorganic material, such as a naturally occurring material (e.g., a mineral) or synthetically created composition. Some suitable inorganic materials may include oxides, carbides, nitrides, oxycarbides, oxynitrides, diamonds, other natural minerals or a combination thereof. In certain, non-limiting embodiments, the abrasive particle may be cBN, fused alumina, sintered alumina, silicon carbide, or mixtures thereof.

The abrasive particles of the embodiments herein may include a coating, which may facilitate formation and performance of the abrasive tool. In certain embodiments, the coating may be a metal coating, for example, nickel. According to still other embodiments, the coating may be iron oxide, a silane, such as, gamma amino propyl triethoxy silane, or even silica.

According to certain embodiments, the coating of the abrasive particles may have a specific thickness. For example, the average thickness of the coating of the abrasive particles can be at least about 1.25 microns, such as, at least about 1.5 microns, at least about 1.75 microns, at least about 2.0 microns, at least about 2.25 microns, at least about 2.5 microns, or at least about 3.0 microns. The average thickness can be limited, however, such as not greater than about 8.0 microns, not greater than about 7.5 microns, not greater than 7.0 microns, not greater than 6.5 microns, not greater than 6.0 microns, not greater than 5.5 microns, not greater than 5.0 microns, not greater than 4.5 microns, or not greater than 4.0 microns. It will be appreciated that the average thickness of the coating may be any value within a range between any of the minimum and maximum values noted above.

According to other embodiments, the coating of the abrasive particles can be formed to overlie specific portion of the exterior surface of the abrasive particle. For example, the coating may overly at least about 50% of the exterior surface area of the abrasive particle, such as, at least about 60%, at least about 70%, at least about 80%, at least about 90%, even at least about 95%, or essentially the entire exterior surface of the abrasive particles. In still other non-limiting embodiments, the coating may overly not greater than about 99% of the exterior surface area of the abrasive particle, such as, not greater than about 95%, not greater than about 90%, not greater than about 80%, not greater than about 70% or even not greater than about 60% of the exterior surface of the abrasive particles. It will be appreciated that the coating may overly any percent of the abrasive particle within a range between any of the minimum and maximum values noted above.

In further reference to the abrasive particles, the morphology of the abrasive particles may be described by an aspect ratio, which is a ratio between the dimensions of length to width. It will be appreciated that the length is the longest dimension of the abrasive particle and the width is the second longest dimension of a given abrasive particle. In accordance with embodiments herein, the abrasive particles may have an aspect ratio (length:width) of not greater than about 2:1 or even not greater than about 1.5:1. In particular instances, the abrasive particles may be essentially equiaxed, such that they have an aspect ratio of approximately 1:1.

Referring back to FIG. 1, after providing a mixture in step 101, the process may continue at step 102 by forming a bonded abrasive tool incorporating abrasive particles within the bond material. The mixture containing the abrasive particles and unprocessed bond material may be formed into any desired three-dimensional shape of any desired size, for example, the mixture may be formed into wheels, discs, segments, mounted points, hones and other article shapes, which may be mounted onto a machining apparatus, such as a grinding or polishing apparatus.

In certain embodiments, the mixture may be formed into a bonded abrasive tool using hot-pressing. Hot-pressing of the mixture may be carried out at a temperature of at least about 750° C., such as, at least about 800° C., at least about 850° C., at least about 900° C., at least about 950° C. or even at least about 990° C. In still other embodiments, hot-pressing of the mixture may be carried out at a temperature of not greater than about 1000° C., not greater than about 950° C., not greater than about 900° C., not greater than about 850° C., not greater than about 800° C., not greater than about 750° or even not greater than about 710° C. It will be appreciated that hot-pressing of the mixture may be carried out at any temperature within a range between any of the minimum and maximum values noted above.

According to other embodiments, hot-pressing of the mixture may be carried out at a pressure of at least about 0.5 tons/in$^2$, such as, at least about 1.0 tons/in$^2$, at least about 1.5 tons/in$^2$, at least about 2.0 tons/in$^2$, at least about 2.5 tons/in$^2$ or even a least about 2.9 tons/in$^2$. In still other embodiments, hot-pressing of the mixture may be carried out at a pressure of not greater than about 3 tons/in$^2$, not greater than about 2.5 tons/in$^2$, not greater than about 2.0 tons/in$^2$, not greater than about 1.5 tons/in$^2$ or even not greater than about 2.0 tons/in$^2$. It will be appreciated that hot-pressing of the mixture may be carried out at any pressure within a range between any of the minimum and maximum values noted above.

In still other embodiments, the mixture may be formed into a bonded abrasive tool using cold-pressing. Cold-pressing of the mixture may be carried out at a temperature of at least about 750° C., such as, at least about 800° C., at least about 850° C., at least about 900° C., at least about 950° C. or even at least about 990° C. In still other embodiments, cold-pressing of the mixture may be carried out at a temperature of not greater than about 1000° C., not greater than about 950° C., not greater than about 900° C., not greater than about 850° C., not greater than about 800° C., not greater than about 750° or even not greater than about 710° C. It will be appreciated that cold-pressing of the mixture may be carried out at any temperature within a range between any of the minimum and maximum values noted above.

According to other embodiments, cold-pressing of the mixture may be carried out at a pressure of at least about 5 tons/in$^2$, such as, at least about 10 ton/in$^2$, 20 tons/in$^2$, at least about 25 tons/in$^2$, at least about 30 tons/in$^2$, at least about 35 tons/in$^2$, at least about 40 tons/in$^2$ or even a least about 45 tons/in$^2$. In still other embodiments, cold-pressing of the mixture may be carried out at a temperature of not greater than about 50 tons/in$^2$, not greater than about 45 tons/in$^2$, not greater than about 40 tons/in$^2$, not greater than about 35 tons/in$^2$, not greater than about 30 tons/in$^2$ or even not greater than about 25 tons/in$^2$. It will be appreciated that cold-pressing of the mixture may be carried out at any pressure within a range between any of the minimum and maximum values noted above.

In accordance with embodiments described herein, the formed abrasive article may have a body having particular features.

Referring in particular to the bond material, according to certain embodiments, the bond material may include a specific content of a copper-containing compound, which may include a material including a measurable content of copper, and more particularly, may be a copper-based material. For example, a copper-containing material can have at least about 1% copper, such as at least about 10% copper, at least about 20% copper, or even may contain a majority content of copper (i.e., at least about 51%) for a total weight of the copper-containing compound. The copper-containing compound may be a metal, such as a metal alloy, and more particularly, a copper-based metal alloy containing a majority content of copper compared to any other metal element.

In one embodiment, the bond material may include not greater than about 50 wt. % copper-containing compound for the total weight of the bond material, such as, not greater than about 45 wt. %, not greater than about 35 wt. %, not greater than about 30 wt. %, not greater than about 25 wt. %, not greater than about 20 wt. % or even not greater than about 15 wt. % copper-containing compound for the total weight of the bond material. In certain other non-limiting embodiments, the bond material may include at least about 10 wt. % copper-containing compound for the total weight of the bond material, such as, at least about 15 wt. %, at least about 20 wt. %, at least about 25 wt. %, at least about 30 wt. %, at least about 35 wt. %, at least about 40 wt. %, at least about 45 wt. % or even at least about 50 wt. % copper-containing compound for the total weight of the bond material. It will be appreciated that the content of copper-containing compound in the bond material may be any value within a range between any of the minimum and maximum values noted above.

According to other embodiments, the copper-containing compound may be elemental copper. In certain non-limiting embodiments, the bond material may include a specific content of elemental copper. For example, the bond material may include not greater than about 50 wt. % elemental copper for the total weight of the bond material, such as, not greater than about 45 wt. %, not greater than about 35 wt. %, not greater than about 30 wt. %, not greater than about 25 wt. %, not greater than about 20 wt. % or even not greater than about 15 wt. % for the total weight of the bond material. In certain other non-limiting embodiments, the bond material may include at least about 10 wt. % elemental copper for the total weight of the bond material, such as, at least about 15 wt. %, at least about 20 wt. %, at least about 25 wt. %, at least about 30 wt. %, at least about 35 wt. %, at least about 40 wt. %, at least about 45 wt. %, or even at least about 50 wt. % elemental copper for the total weight of the bond material. It will be appreciated that the content of elemental copper in the bond material may be any value within a range between any of the minimum and maximum values noted above.

According to yet other embodiments, the copper-containing compound may be a pre-alloyed bronze. In certain non-limiting embodiments, the bond material may include a specific content of pre-alloyed bronze. For example, the bond material may include not greater than about 50 wt. % pre-alloyed bronze for the total weight of the bond material, such as, not greater than about 45 wt. %, not greater than about 35 wt. %, not greater than about 30 wt. %, not greater than about 25 wt. %, not greater than about 20 wt. % or even not greater than about 15 wt. % pre-alloyed bronze for the total weight of the bond material. According to yet other non-limiting embodiments, the body may include at least about 10 wt. % pre-alloyed bronze for the total weight of the bond material, such as, at least about 15 wt. %, at least about 20 wt. %, at least about 25 wt. %, at least about 30 wt. %, at least about 35 wt. %, at least about 40 wt. %, at least about 45 wt. %, or even at least about 50 wt. %. It will be appreciated that the content of pre-alloyed bronze in the bond material may be any value within a range between any of the minimum and maximum values noted above.

According to still other particular embodiments, the pre-alloyed bronze may have a particular ratio ($C_{Sn}/C_{Cu}$) of a content of Sn ($C_{Sn}$) to a content of Cu ($C_{Cu}$), wherein $C_{Sn}$ represents the content of Sn in the bronze measured as a wt. % of the total weight of the bronze and $C_{Cu}$ represents the content of Cu in the bronze measured as a wt. % of the total weight of the bronze. In one instance, the pre-alloyed bronze may have a ratio $C_{Sn}/C_{Cu}$ of not greater than about 2.0, such as, not greater than about 1.8, not greater than about 1.6, not greater than about 1.4, not greater than about 1.2, not greater than about 1.0, not greater than about 0.8, not greater than about 0.7, not greater than about 0.65, not greater than about 0.64, not greater than about 0.63, not greater than about 0.62, not greater than about 0.61, not greater than about 0.60, not greater than about 0.59, not greater than about 0.58, not greater than about 0.57, not greater than about 0.56, not greater than about 0.55, not greater than about 0.54, not greater than about 0.53, not greater than about 0.52, not greater than about 0.51, not greater than about 0.50, not greater than about 0.49, not greater than about 0.48, not greater than about 0.47, not greater than about 0.46, not greater than about 0.45, not greater than about 0.44, not greater than about 0.43, not greater than about 0.42, not greater than about 0.41, not greater than about 0.40, not greater than about 0.39, not greater than about 0.38, not greater than about 0.37, not greater than about 0.36, not greater than about 0.35, not greater than about 0.34, not greater than about 0.33, not greater than about 0.32, not greater than about 0.31, not greater than about 0.30, not greater than about 0.28, not greater than about 0.26, not greater than about 0.24, not greater than about 0.22, not greater than about 0.20, not greater than about 0.15 or even not greater than about 0.12. According to yet another non-limiting embodiment, the pre-alloyed bronze may have a ratio $C_{Sn}/C_{Cu}$ of at least about 0.10, such as, at least about 0.15, at least about 0.20, at least about 0.22, at least about 0.24, at least about 0.26, at least about 0.28, at least about 030, at least about 0.31, at least about 0.32, at least about 0.33, at least about 0.34, at least about 0.35, at least about 0.36, at least about 0.37, at least about 0.38, at least about 0.39, at least about 0.40, at least about 0.41, at least about 0.42, at least about 0.43, at least about 0.44, at least about 0.45, at least about 0.46, at least about 0.47, at least about 0.48, at least about 0.49, at least about 0.50, at least about 0.51, at least about 0.52, at least about 0.53, at least about 0.54, at least about 0.55, at least about 0.56, at least about 0.57, at least about 0.58, at least about 0.59, at least about 0.60, at least about 0.65, at least about 0.70, at least about 0.80 or even at least about 1.0. It will be appreciated that the pre-alloyed bronze may have a ratio $C_{Sn}/C_{Cu}$ within a range between any of the minimum and maximum values described above. In one particular instance, the pre-alloyed bronze may be, for example, within a range of 60/40 to 40/60 copper/tin by weight (e.g., 50/50 by weight %).

According to other particular embodiments, the pre-alloyed bronze may include a certain content of copper. For example, the pre-alloyed bronze may include at least about 60 wt. % copper, such as, at least about 65 wt. % copper, at least about 70 wt. % copper, at least about 75 wt. % copper, at least about 80 wt. % copper, at least about 85 wt. % copper, at least about 90 wt. % copper or even at least about 95 wt. % copper for the total weight of the metal alloy. According to other embodiments, the pre-alloyed bronze may include not greater than about 99 wt. % copper for the total weight of the pre-alloyed bronze, such as, not greater than about 95 wt. % copper, not greater than about 90 wt. % copper, not greater than about 85 wt. % copper, not greater than about 80 wt. % copper, not greater than about 75 wt. % copper, not greater than about 70 wt. % copper or even not greater than about 65 wt. % for the total weight of the pre-alloyed bronze. It will be appreciated that content of copper in the pre-alloyed bronze may be any value within a range of between any of the minimum and maximum values described herein.

According to yet other embodiments, the pre-alloyed bronze may include a certain content of tin. For example, the pre-alloyed bronze may include at least about 5 wt. % tin of the total weight of the pre-alloyed bronze, such as, at least about 10 wt. %, at least about 15 wt. %, at least about 20 wt. %, at least about 25 wt. %, at least about 30 wt. %, at least about 35 wt. % or even at least about 40 wt. % for the total weight of the metal alloy. In other embodiments, the amount of tin may be not greater than about 45 wt. % for the total weight of the pre-alloyed bronze, not greater than about 40 wt. %, not greater than about 35 wt. %, not greater than about 30 wt. %, not greater than about 25 wt. %, not greater than about 20 wt. %, not greater than about 15 wt. % or even not greater than about 10 wt. % for the total weight of the pre-alloyed bronze. It will be appreciated that the content of tin in the pre-alloyed bronze may be within a range between any of the minimum and maximum values described herein.

According to yet other embodiments, the bond material may include a specific content of tin. For example, the bond material may include not greater than about 20 wt. % tin for the total weight of the bond material, such as not greater than about 15 wt. %, not greater than about 10 wt. %, not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, or even not greater than about 1 wt. % tin for the total weight of the bond material. In certain other non-limiting embodiments, the bond may include at least about 0.5 wt. % tin for the total weight of the bond material, such as, at least about 1.0 wt. %, at least about 2.0 wt. %, at least about 3.0 wt. %, at least about 4.0 wt. %, at least about 5 wt. %, at least about 6 wt. %, at least about 7 wt. %, at least about 8 wt. %, at least about 9 wt. %, at least about 10 wt. %, at least about 15 wt. % or even at least about 19 wt. % tin for the total weight of the bond material. It will be appreciated that the content of tin in the bond material may be any value within a range between any of the minimum and maximum values noted above.

According to still other embodiments, the body may include a specific content of elemental chromium. For example, the bond material may include not greater than about 10 wt. % elemental chromium for the total weight of the bond material, such as, not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, or even not greater than about 1 wt. % elemental chromium for the total weight of the bond material. In certain other embodiments, the bond material may be essentially free of elemental chromium. In still other non-limiting embodiments, the bond material may include at least about 0.1 wt. % chromium for the total weight of the bond material, such as at least about 1 wt. % or even at least about 5 wt. % elemental chromium for the total weight of the bond material. It will be appreciated that the content of elemental chromium in the bond material may be any value within a range between any of the minimum and maximum values noted above.

In still other embodiments, the bond material may include a specific content of elemental nickel. For example, the bond material may include not greater than about 10 wt. % elemental nickel for the total weight of the bond material, such as, not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, or even not greater than about 1 wt. % elemental nickel for the total weight of the bond material. In certain other embodiments, the bond material may be essentially free of elemental nickel. In still other non-limiting embodiments, the bond material may include at least about 0.1 wt. % elemental nickel for the total weight of the bond material, such as at least about 1 wt. % or even at least about 5 wt. % elemental nickel for the total weight of the bond material. It will be appreciated that the content of elemental nickel in the bond material may be any value within a range between any of the minimum and maximum values noted above.

Referring in particular to the filler material included in the bond material of the abrasive tool, according to certain embodiments, the bond material may include a specific content of tungsten. For example, the bond material may include not greater than about 10 wt. % tungsten for a total weight of the bond material, such as not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, or even not greater than about 1 wt. % tungsten for the total weight of the bond material. In certain other embodiments, the bond material may be essentially free of tungsten. In still other non-limiting embodiments, the bond material may include at least about 0.1 wt. % tungsten for the total weight of the bond material, such as at least about 1 wt. % or even at least about 5 wt. % tungsten for the total weight of the bond material. It will be appreciated that the content of tungsten in the bond material may be any value within a range between any of the minimum and maximum values noted above.

According to yet other embodiments, the bond material may include a specific content of cast iron. For example, the bond material may include not greater than about 75 wt. % cast iron for the total weight of the bond material, not greater than about 70 wt. %, not greater than about 65 wt. %, not greater than about 60 wt. %, not greater than about 55 wt. %, not greater than about 50 wt. %, not greater than about 45 wt. %, not greater than about 40 wt. % or even not greater than about 35 wt. % cast iron for the total weight of the bond material. In still other non-limiting embodiments, the bond material may include at least about 10 wt. % cast iron for the total weight of the bond material, such as at least about 15 wt. %, at least about 20 wt. %, at least about 25 wt. %, at least about 35 wt. %, at least about 40 wt. %, at least about 45 wt. %, at least about 50 wt. %, at least about 55 wt. %, at least about 60 wt. %, at least about 65 wt. % or even at least about 70 wt. % cast iron for the total weight of the bond material. It will be appreciated that the content of cast iron in the bond material may be any value within a range between any of the minimum and maximum values noted above.

In still other embodiments, the cast iron may be an alloy that may include a specific content of carbon. For example, the cast iron may include not greater than about 5 wt. % carbon for the total weight of the cast iron, such as, not greater than about 4.5 wt. %, not greater than about 4.0 wt. %, not greater than about 3.5 wt. %, not greater than about 3.0 wt. %, not greater than about 2.5 wt. %, not greater than about 2.0 wt. %, not greater than about 1.5 wt. %, not greater than about 1.0 wt. %, or even not greater than about 0.5 wt. % carbon for the total weight of the cast iron. In still other embodiments, the cast iron may include at least about 0.5 wt. % carbon for the total weight of the cast iron, such as, at least about 1.0 wt. %, at least about 1.5 wt. %, at least about 2.0 wt. %, at least about 2.5 wt. %, at least about 3.0 wt. %, at least about 3.5 wt. %, at least about 4.0 wt. %, at least about 4.5 wt. % or even at least about 4.9 wt. % carbon for the total weight of the cast iron. It will be appreciated that the content of carbon in the cast iron may be any value within a range between any of the minimum and maximum values noted above.

In still other embodiments, the cast iron may be an alloy that may include a specific content of chromium, which is distinct from free or elemental chromium contained in bond material. For example, the cast iron may include not greater than about 5 wt. % chromium for a total weight of the cast iron, such as, not greater than about 4.5 wt. %, not greater than about 4.0 wt. %, not greater than about 3.5 wt. %, not greater than about 3.0 wt. %, not greater than about 2.5 wt. %, not greater than about 2.0 wt. %, not greater than about 1.5 wt. %, not greater than about 1.0 wt. % or even not greater than about 0.5 wt. % chromium for the total weight of the cast iron. In certain other non-limited embodiments, the cast iron may include at least about 0.5 wt. % chromium for the total weight of the cast iron, such as, at least about 1.0 wt. %, at least about 1.5 wt. %, at least about 2.0 wt. %, at least about 2.5 wt. %, at least about 3.0 wt. %, at least about 3.5 wt. %, at least about 4.0 wt. %, at least about 4.5 wt. %, or even at least about 4.9 wt. % chromium for the total content of cast iron. It will be appreciated that the content of chromium in the cast iron may be any value within a range between any of the minimum and maximum values noted above.

In certain instances, the bond material can include an active bonding agent. The active bonding agent can include titanium-containing compositions, which may include any material including a measurable content of titanium, and more particularly, may be a titanium-based material. For example, a titanium-containing composition can have at least about 1 wt % titanium for the total weight of the titanium-containing composition, such as, at least about 10 wt. % titanium, at least about 20 wt. % titanium or even may contain a majority content of titanium (i.e., at least about 51 wt. %) for a total weight of the titanium-containing compound. The titanium-containing compound may be a metal, such as a metal alloy, and more particularly, a titanium-based metal alloy containing a majority content of titanium compared to any other metal element. It will be appreciated that the titanium-containing composition may be formed by a chemical process from an unprocessed bonding agent, for example, titanium hydride, in the unprocessed mixture. It will be further appreciated that the titanium-containing composition may include multiple distinct titanium-containing compositions within the bond material.

According to one embodiment, the bond material may include a particular content of titanium-containing compositions, including for example, not greater than about 10 wt. % titanium-containing compositions for the total weight of the bond material, such as not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. % or even not greater than about 1 wt. % titanium-containing compositions for the total weight of the bond material. In certain other embodiments, the bond material may include at least about 1 wt. % titanium-containing compositions for the total weight of the bond material, such as, at least about 2 wt. %, at least about 3 wt. %, at least about 4 wt. %, at least about 5 wt. %, at least about 6 wt. %, at least about 7 wt. %, at least about 8 wt. %, at least about 9 wt. %, or even at least about 10 wt. % titanium-containing compositions for the total weight of the bond material. It will be appreciated that the content of titanium-containing compositions in the bond material may be any value within a range between any of the minimum and maximum values noted above.

According to yet other embodiments, the bond material may include a plurality of titanium-containing compositions, which can differ from each other based on composition. The plurality of titanium-containing compositions may be a result of the unprocessed bonding agent chemically dissociating during processing and forming new titanium-containing compositions within the bond. In one embodiment, the bond material may include a first titanium-containing composition that can be preferentially located adjacent to cast iron within the bond material and a second titanium-containing composition that may be preferentially located adjacent to abrasive particles within the bond material.

The combination of components within the bond material may be controlled to facilitate formation of particular contents of titanium-containing compositions. For example, in certain embodiments, the first titanium-containing composition may include a titanium-tin alloy and the second titanium-containing composition may include titanium carbide. In still other embodiments, the body may include a content of the first titanium-containing composition (TCC1) and a content of the second titanium-containing composition (TCC2). In certain embodiments, the content of the first titanium-containing composition may be greater than the content of the second titanium-containing composition. It will be appreciated that TCC1 represents the content of the first titanium-containing composition in the bond material in wt. % for the total weight of the bond material and TCC2 represents the content of the second titanium-containing composition in the bond material in wt. % for the total weight of the bond material.

According to yet another embodiment, the body may include a ratio (TCC1/TCC2) of the first titanium-containing composition (TCC1) to the content of the second titanium-containing composition (TCC2) in the bond, which can facilitate formation and performance of the abrasive tools of the embodiments herein. In certain embodiments the ratio (TCC1/TCC2) may be not greater than about 2, such as not greater than about 1.8, not greater than about 1.6, not greater than about 1.4, not greater than about 1.2, not greater than about 1.0, not greater than about 0.8, not greater than about 0.6, not greater than about 0.4, or even not greater than about 0.2. In certain other embodiments the ratio TCC1/TCC2 may be at least about 0.1, such as at least about 0.2, at least about 0.4, at least about 0.6, at least about 0.8, at least about 1.0, at least about 1.2, at least about 1.4, at least about 1.6, at least about 1.8, or at least about 1.9. It will be appreciated that the ratio TCC1/TCC2 may be any value within a range between any of the minimum and maximum values noted above.

According to still other specific embodiments, the body may include a ratio (W/CI) of the content of tungsten (W) in the bond material to the content of cast-iron (CI) in the bond material, which may facilitate formation and performance of the abrasive tools of the embodiments herein. In the ratio (W/CI), W represents the content of tungsten in the bond material in wt. % for the total weight of the bond material and CI represents the content of cast iron in the bond material in wt. % for the total weight of the bond material. In certain embodiments the ratio W/CI may be not greater than about 0.9, such as, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 or even not greater than about 0.005. In certain other non-limiting embodiments the ratio W/CI may be essentially 0. In yet other embodiments, the ratio W/CI may be at least about 0.001, such as, at least about 0.005, at least about 0.01, at least about 0.05 or even at least about 0.1. It will be appreciated that the ratio W/CI may be any value within a range between any of the minimum and maximum values noted above.

According to yet another embodiment, the body may include a ratio (CCC/CI) of the content of copper-containing compositions (CCC) to the content of cast iron (CI) in the bond material. In the ratio (CCC/CI), CCC represents the content of copper-containing compositions in the bond material in wt. % for the total weight of the bond material and CI represents the content of cast iron in the bond material in wt. % for the total weight of the bond material. In certain embodiments, the ratio CCC/CI may be not greater than about 0.9, such as, not greater than about 0.8, not greater than about 0.75, not greater than about 0.7 or even not greater than about 0.68. According to yet another non-limiting embodiment, the ratio CCC/CI may be at least about 0.1, such as, at least about 0.2, at least about 0.3, at least about 0.35, at least about 0.4, at least about 0.45, at least about 0.5, at least about 0.55 or even at least about 0.6. It will be appreciated that the ratio CCC/CI may be any value within a range between any of the minimum and maximum values noted above.

In still other embodiments, the body may include a ratio (TiCC/CI) of the content of titanium-containing composition (TiCC) to the content of cast iron (CI) in the bond material. In the ratio (TiCC/CI), TiCC represents the content of titanium-containing compositions in the bond material in wt. % for the total weight of the bond material and CI represents the content of cast iron in the bond material in wt. % for the total weight of the bond material. In certain embodiments, the ratio TiCC/CI may be not greater than about 0.9, such as, not greater than about 0.8, not greater than about 0.7, not greater than about 0.6, not greater than about 0.5, not greater than about 0.4, not greater than about 0.35, not greater than about 0.3, not greater than about 0.28, not greater than about 0.25, not greater than about 0.23 or even not greater than about 0.2. In certain other embodiments, the ratio TiCC/CI may be at least about 0.01, such as, at least about 0.05, at least about 0.08, at least about 0.1, at least about 0.12, at least about 0.14 or even at least about 0.16. It will be appreciated that the ratio TiCC/CI may be any value within a range between any of the minimum and maximum values noted above.

Accordingly to yet other embodiments, the body may include a ratio (WC/CI) of the content of tungsten carbide (WC) to the content of cast iron (CI) in the bond material. In the ratio (WC/CI)), WC represents the content of tungsten carbide in the bond material in wt. % for the total weight of the bond material and CI represents the content of cast iron in the bond material in wt. % for the total weight of the bond material. In certain embodiments the ratio WC/CI may be not greater than about 0.9, such as, not greater than about 0.8, not greater than about 0.7, not greater than about 0.6, not greater than about 0.5, not greater than about 0.4, not greater than about 0.3, not greater than about 0.2, not greater than about 0.1 or even not greater than about 0.01. In certain other embodiments the ratio WC/CI may be essentially 0. In yet other embodiments, the ratio WC/CI may be at least about 0.01. It will be appreciated that the ratio WC/CI may be any value within a range between any of the minimum and maximum values noted above.

According to still other embodiments, the body may include a ratio (WC/CCC) of the content of tungsten carbide (WC) to the content of copper-containing compositions (CCC) in the bond material. In the ratio (WC/CCC), WC represents the content of tungsten carbide in the bond material in wt. % for the total weight of the bond material CCC represents the content of copper-containing compositions in the bond material in wt. % for the total weight of the bond material. In certain embodiments, the ratio WC/CCC may be not greater than about 0.9, such as, not greater than about 0.8, not greater than about 0.7, not greater than about 0.6, not greater than about 0.5, not greater than about 0.4, not greater than about 0.3, not greater than about 0.2, not greater than about 0.1 or even not greater than about 0.01. In certain other embodiments the ratio WC/CCC may be essentially 0. In yet other embodiments, the ratio WC/CCC may be at least about 0.001. It will be appreciated that the ratio WC/CCC may be any value within a range between any of the minimum and maximum values noted above.

According to still other embodiments, the body may include a ratio ((CCC+TiCC)/CI) of the content of copper-containing compositions (CCC) and the content of titanium-containing compositions (TiCC) to the content of cast iron (CI) in the bond material. In the ratio ((CCC+TiCC)/CI), CCC represents the content of copper-containing compositions in the bond material in wt. % for the total weight of the bond material, TiCC represents the content of titanium-containing compositions in the bond material in wt. % for the total weight of the bond material and CI represents the content of cast iron in the bond material in wt. % for the total weight of the bond material. In certain embodiments, the ratio (CCC+TiCC)/CI may be not greater than about 1.4, such as, not greater than about 1.3, not greater than about 1.2, not greater than about 1, not greater than about 0.98, not greater than about 0.96, not greater than about 0.94, not greater than about 0.92, not greater than about 0.9, not greater than about 0.88, not greater than about 0.86 or even not greater than about 0.84. In certain other non-limiting embodiments, the ratio (CCC+TiCC)/CI may be at least about 0.1, such as, at least about 0.2, at least about 0.3, at least about 0.4, at least about 0.5, at least about 0.6, at least about 0.7, at least about 0.72, at least about 0.74, at least about 0.76, at least about 0.78 or even at least about 0.8. It will be appreciated that the ratio (CCC+TiCC)/CI may be any value within a range between any of the minimum and maximum values noted above.

According to yet another embodiment, the body may include a ratio (Ni/CI) of the content of nickel (Ni) to the content of cast iron (CI) in the bond material. In the ratio (Ni/CI), Ni represents the content of nickel in the bond material in wt. % for the total weight of the bond material and CI represents the content of cast iron in the bond material in wt. % for the total weight of the bond material. In certain embodiments, the ratio Ni/CI may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.5, not greater than about 0.1, or even not greater than about 0.005. In certain other embodiments the ratio Ni/CI may be essentially 0. In still other embodiments, the ratio Ni/CI may be at least about 0.001. It will be appreciated that the ratio Ni/CI may be any value within a range between any of the minimum and maximum values noted above.

According to still other embodiments, the body may include a ratio (Cr/CI) of the content of chromium (Cr) to the content of cast iron (CI) in the bond material. In the ratio (Cr/CI), Cr represents the content of chromium in the bond material in wt. % for the total weight of the bond material and CI represents the content of cast iron in the bond material in wt. % for the total weight of the bond material. In certain embodiments the ratio Cr/CI may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01, or even not greater than about 0.005. In certain other embodiments, the ratio Cr/CI may be essentially 0. In still other embodiments, the ratio Cr/CI may be at least about 0.001, such as, at least about 0.005, at least about 0.01, at least about 0.05, at least about 0.1, at least about 0.2, at least about 0.3, at least about 0.4, at least about 0.5, at least about 0.6, at least about 0.7, at least about 0.8 or even at least about 0.9. It will be appreciated that the ratio Cr/CI may be any value within a range between any of the minimum and maximum values noted above.

In still other non-limiting embodiments, the body may include a ratio (W/CCC) of the content of tungsten (W) to the content of copper-containing compositions (CCC) in the bond material. In the ratio (W/CCC), W represents the content of tungsten in the bond material in wt. % for the total weight of the bond material and CCC represents the content of copper-containing compositions in the bond material in wt. % for the total weight of the bond material. In certain embodiments, the ratio W/CCC may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 or even not greater than about 0.005. In certain other embodiments, the ratio W/CCC may be essentially 0. In still other non-limiting embodiments, the ratio W/CCC may be at least about 0.001. It will be appreciated that the ratio W/CCC may be any value within a range between any of the minimum and maximum values noted above.

Accordingly to still other embodiments, the body may include a ratio (W/TiCC) of the content of tungsten (W) to the content of titanium-containing compositions (TiCC) in the bond material. In the ratio (W/TiCC), W represents the content of tungsten in the bond material in wt. % for the total weight of the bond material and TiCC represents the content of titanium-containing compositions in the bond material in wt. % for the total weight of the bond material. In certain embodiments, the ratio W/TiCC may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, or even not greater than about 0.1. In certain other embodiments, the ratio W/TiCC may be essentially 0. In still other embodiments the ratio W/TiCC may be at least about 0.001. It will be appreciated that the ratio W/TiCC may be any value within a range between any of the minimum and maximum values noted above.

According to still other embodiments, the body may include a ratio (TiCC/AP) of the content of titanium-containing compositions (TiCC) to the content of abrasive particles (AP) in the body. In the ratio TiCC/AP, TiCC represents the content of titanium-containing compositions in the bond material in vol. % for the total volume of the bond material and AP represents the content of abrasive particles in the body in vol. % for the total volume of the body. In certain embodiments, the ratio TiCC/AP may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.5, not greater than about 0.01 or even not greater than about 0.005. In certain other non-limiting embodiments, the ratio TiCC/AP may be at least about 0.001, such as, at least about 0.005, at least about 0.01, at least about 0.05, at least about 0.1, at least about 0.2, at least about 0.3, at least about 0.4, at least about 0.5, at least about 0.6, at least about 0.7, at least about 0.8 or even at least about 0.9. It will be appreciated that the ratio TiCC/AP may be any value within a range between any of the minimum and maximum values noted above.

According to yet another embodiment, the body may include a ratio (CI/AP) of the content of cast iron (CI) to the content of abrasive particles (AP) in the body. In the ratio (CI/AP), CI represents the content of cast iron in the bond material in vol. % for the total volume of the bond material and AP represents the content of abrasive particles in the body in vol. % for the total volume of the body. In certain embodiments the ratio CI/AP may be not greater than about 1, such as, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 or even not greater than about 0.005. In certain other embodiments, the ratio CI/AP may be at least about 0.001, at least about 0.005, at least about 0.01, at least about 0.05, at least about 0.1, at least about 0.2, at least about 0.3, at least about 0.4, at least about 0.5, at least about 0.6, at least about 0.7, at least about 0.8 or even at least about 0.9. It will be appreciated that the ratio CI/AP may be any value within a range between any of the minimum and maximum values noted above.

Accordingly to yet another embodiment, the abrasive particles may be a superabrasive material. In certain other embodiments, the abrasive material may include a material selected from the group consisting of diamond, cubic boron nitride, and a combination thereof. In still other embodiments, the super abrasive material may consist essentially of diamond. In still other embodiments, the super abrasive material may consist essentially of cubic boron nitride. In still other embodiments the super abrasive material may have a Mohs hardness of at least about 8, such as, at least about 8.5 or even at least about 9.

According to yet another embodiment, the abrasive particles may have a coefficient of thermal expansion (CTEab) and the bond material may have a coefficient of thermal expansion of (CTEbm). In certain embodiments, the absolute value of the difference between the coefficient of thermal expansion for the abrasive particles and the coefficient of thermal expansion for the bond material may be particularly controlled to facilitate formation and performance of the abrasive tools of the embodiments herein. The absolute value of the difference between the coefficient of thermal expansion for the abrasive particles and the coefficient of thermal expansion for the bond material may be represented by the equation $|CTEab-CTEbm|$. In certain embodiments, the absolute value of the difference between the coefficient of thermal expansion for the abrasive particles and the coefficient of thermal expansion for the bond material may be not greater than about 20 m/m/° K, such as, not greater than about 18 m/m/° K, not greater than about 16 m/m/° K, not greater than about 14 m/m/° K, not greater than about 12 m/m/° K, not greater than about 10 m/m/° K, not greater than about 8 m/m/° K, not greater than about 6 m/m/° K, not greater than about 4 m/m/° K or even not greater than about 2 m/m/° K. In still other embodiments, the absolute value of the difference between the coefficient of thermal expansion for the abrasive particles and the coefficient of thermal expansion for the bond material may be at least about 1 m/m/° K, such as, at least about 2 m/m/° K, at least about 4 m/m/° K, at least about 6 m/m/° K, at least about 8 m/m/° K, at least about 10 m/m/° K, at least about 12 m/m/° K, at least about 14 m/m/° K, at least about 16 m/m/° K, or even at least about 18 m/m/° K. It will be appreciated that the difference between the coefficient of thermal expansion for the abrasive particles and the coefficient of thermal expansion for the bond material may be any value within any of the minimum and maximum values noted above.

In yet another embodiment, a copper-containing composition may have a specific melting point (CCCmp) and the cast iron may have a specific melting point (CImp). In certain embodiments, the absolute value of the difference between the melting point for the copper-containing compositions (CCCmp) and the melting point for the cast iron (CImp) may be represented by the equation |CCCmp-CImp|. In certain embodiments the difference between the melting point of the copper-containing compositions and the melting point of the cast iron may be not greater than about 1000° C., not greater than about 500° C., not greater than about 250° C., not greater than about 100° C., not greater than about 80° C., not greater than about 70° C., not greater than about 60° C., not greater than about 50° C., not greater than about 40° C., not greater than about 30° C., not greater than about 20° C., not greater than about 10° C. or even not greater than about 5° C. In still other embodiments, the difference between the melting point of the copper-containing compositions and the melting point of the cast iron may be at least about 1° C., at least about 10° C., at least about 20° C., at least about 30° C., at least about 40° C., at least about 50° C., at least about 60° C., at least about 70° C., at least about 80° C., at least about 90° C., at least about 100° C., at least about 250° C., at least about 500° C. or even at least about 990° C. It will be appreciated that the difference between the melting point of the copper-containing compositions and the melting point of the cast iron may be any value within a range between any of the minimum and maximum values noted above.

In still other embodiments, the bond material may include a copper-containing composition having a melting temperature of not greater than about 1000° C., not greater than about 950° C., not greater than about 900° C., not greater than about 850° C., not greater than about 800° C., not greater than about 750° C., not greater than about 700° C., not greater than about 650° C., not greater than about 600° C., not greater than about 550° C., not greater than about 500° C., not greater than about 450° C. or even not greater than about 410° C. In still other embodiments, the copper-containing composition having a melting temperature of at least about 400° C., at least about 450° C., at least about 500° C., at least about 550° C., at least about 600° C., at least about 650° C., at least about 700° C., at least about 750° C., at least about 800° C., at least about 850° C., at least about 900° C., at least about 950° C. or even at least about 990° C. It will be appreciated that the melting temperature of the copper-containing composition may be any value within a range between any of the minimum and maximum values noted above.

According to still other embodiments, the bond material may include cast iron having a certain average particle size (D50). In certain embodiments, the average particle size (D50) of the cast iron may be not greater than about 300 microns, such as, not greater than about 250 microns, not greater than about 200 microns, not greater than about 150 microns, not greater than about 100 microns, not greater than about 90 microns, not greater than about 80 microns, not greater than about 70 microns, not greater than about 60 microns, not greater than about 50 microns, not greater than about 40 microns, not greater than about 30 microns, not greater than about 20 microns, not greater than about 10 microns, not greater than about 5 microns, or even not greater than about 2 microns. In still other embodiments, the cast iron may have an average particle size (D50) of at least about 1 micron, such as at least about 5 microns, at least about 10 microns, at least about 20 microns, at least about 30 microns, at least about 40 microns, at least about 50 microns, at least about 60 microns, at least about 70 microns, at least about 80 microns, at least about 90 microns, at least about 100 microns, at least about 150 microns, at least about 200 microns, at least about 250 microns, or even at least about 290 microns. It will be appreciated that the average particle size (D50) of the cast iron may be any value within a range between any of the minimum and maximum values noted above.

In still other embodiments, the bond material may include cast iron particles having a particular particle size distribution. In still other embodiments, the particle size distribution may be a Gaussian distribution. In yet other embodiments, the particle size distribution may be a multi-model distribution. In yet other embodiments, the particle size distribution may be a bi-model distribution. In certain embodiments, the bi-model distribution may include a first mode that may include a course particle size and a second mode that may include a fine particle size.

In still other embodiments, the abrasive tool may have a specific Vickers hardness. For example, the abrasive tool may have a Vickers hardness of at least about 103 GPa, at least about 110 GPa, at least about 120 GPa, at least about 130 GPa, at least about 140 GPa or even at least about 145 GPa. In still other embodiments, the abrasive tool may have a Vickers hardness of not greater than about 150 GPa, not greater than about 140 GPa, not greater than about 130 GPa, not greater than about 120 GPa or even not greater than about 110 GPa. It will be appreciated that the abrasive tool may have Vickers hardness of any value within a range between any of the minimum and maximum values noted above.

In yet other embodiments, abrasive tools described herein may have certain high material removal rate characteristics. The high material removal rate characteristics may be selected from the group consisting of a break-in length, a maximum initial speed character, a life span, a dressing frequency, edge quality and a combination thereof. The high material removal rate characteristics are measured according to a standard high material removal rate glass grinding test, which is conducted on a Bystronic Grinder in the presence of a grinding fluid/coolant on a glass workpiece of 6 mm thickness.

In a first portion of the standard high material removal rate glass grinding test, an abrasive tool is traversed along the edge of the workpiece defined by the thickness at a set feed rate. The abrasive tool is applied to the glass at an initial speed of 20 m/min to break-in the abrasive tool. If the initial speed of 20 m/min causes defects, the speed is reduced. The maximum initial speed character is the maximum initial speed of the abrasive tool (m/min) that does not cause defects in the workpiece. Defects can include cracks, microchipping, and burns. Microchipping is a chip in the workpiece that is visible upon inspection without the use of augmenting devices (e.g., a microscope). The break-in length is the length along the workpiece which the abrasive tool traverses before the abrasive tool is conditioned or broken-in (i.e., when the workpiece exhibits no defects at the grinding speed of 20 m/min). If an abrasive tool cannot operate at an initial speed of 20 m/min, then the speed must be reduced initially and gradually increased. The length of material ground until the grinding speed may be returned to 20 m/min without causing defects in the workpiece is the break-in length. If the abrasive tool can immediately operate at an initial speed of 20 m/min without producing defects in the grinding, then it has no break-in length.

In the second portion of the standard high material removal rate glass grinding test, the speed of the abrasive tool is increased up to a running speed of 30 m/min from 20 m/min. The parts/dress is the number of parts grinded between dressing operations of the abrasive tool during the second portion of the standard high material removal rate glass grinding test. The life span of the abrasive tool is the length along the workpiece which the abrasive tool may traverse during the second portion of the standard high material removal rate glass grinding test before the abrasive tool no longer removes material without causing defects (e.g., cracks, microchipping, burns, etc.) in the workpiece. The edge quality is the percentage of the workpiece that is free of defects (e.g., cracks, microchipping, burns, etc.) after being grinded by the abrasive tool during the second portion of the standard high material removal rate glass grinding test.

The abrasive tools of the embodiments herein, may have a break-in length as measured by the first portion of the standard high speed glass grinding test of not greater than about 1000 linear meters, such as, not greater than about 900 linear meters, not greater than about 800 linear meters, not greater than about 700 linear meters, not greater than about 600 linear meters, not greater than about 500 linear meters, not greater than about 400 linear meters, not greater than about 300 linear meters, not greater than about 200 linear meters, not greater than about 100 linear meters, not greater than about 50 linear meters, not greater than about 40 linear meters, not greater than about 30 linear meters, not greater than about 20 linear meters, not greater than about 10 linear meters, not greater than about 5 linear meters or even not greater than about 1 linear meter. In still other embodiments, the abrasive tool may have no break-in period, meaning that the tool may begin grinding at 20 m/min without causing defects (e.g., cracks, microchipping, burns, etc.) on the workpiece. In still other embodiments, the abrasive tool may have a break-in length of at least about 1 meter, such as, at least about 5 meters, at least about 10 meters, at least about 50 meters or even at least about 100 meters. It will be appreciated that the abrasive tool may have a break-in length of any value within a range between any of the minimum and maximum values noted above.

The abrasive tool may have a maximum initial speed character according to the first portion of the standard high material removal rate glass grinding test. For example, the abrasive tool may have a maximum initial speed character of at least about 10 m/min, such as, at least about 12 m/min, at least about 14 m/min, at least about 16 m/min, at least about 18 m/min, at least about 20 m/min, at least about 25 m/min, at least about 30 m/min, at least about 35 m/min, at least about 40 m/min, at least about 45 m/min, at least about 50 m/min, at least about 55 m/min, at least about 60 m/min, at least about 65 m/min, at least about 70 m/min or even at least about 80 m/min. In one non-limiting embodiment, the abrasive tool may have a maximum initial speed character of not greater than about 100 m/min, not greater than about 90 m/min or even not greater than about 80 m/min. It will be appreciated that the abrasive tool may have a maximum initial speed character of any value within a range between any of the minimum and maximum values noted above.

The abrasive tool may have specific life span according to the second portion of the standard high material removal rate glass grinding test. For example, the abrasive tool may have a life span of at least about 1000 linear meters, such as, at least about 1100 linear meters, at least about 1200 linear meters, at least about 1300 linear meters, at least about 1400 linear meters, at least about 1500 linear meters, at least about 2000 linear meters, at least about 300 linear meters or even at least about 500 linear meters. In still other embodiments, the abrasive tool may have a life span of not greater than about 6000 linear meters, such as, not greater than about 5000, linear meters, not greater than about 4000 linear meters or even 3000 linear meters. It will be appreciated that the abrasive tool may have a life span of any value within a range between any of the minimum and maximum values noted above.

The abrasive tool may have a specific dressing frequency according to the second portion of the standard high material removal rate glass grinding test. For example, the abrasive tool may have a dressing frequency of at least about 25 parts/dress, such as, at least about 30 parts/dress, at least about 35 parts/dress or even at least about 40 parts/dress. In still other embodiments, the abrasive tool may have a dressing frequency of not greater than about 50 parts/dress as measured by the dressing frequency test, such as, not greater than about 45 parts/dress, not greater than about 40 parts/dress, not greater than about 35 parts/dress or even not greater than about 30 parts/dress. It will be appreciated that the abrasive tool may have a dressing frequency of any value within a range between any of the minimum and maximum values noted above.

The abrasive tool may provide a specific edge quality according to the standard high material removal rate glass grinding test. For example, the abrasive tool may provide an edge quality of at least about 25% of the workpiece free from defects, such as, at least about 30%, at least about 35%, at least about 40%, at least about 45%, at least about 50%, at least about 55%, at least about 60%, at least about 65%, at least about 70%, at least about 75%, at least about 80%, at least about 85% or even at least about 90% free from defects. In certain embodiments, the abrasive tool may provide an edge quality such that the workpiece is substantially free of defects. In still other embodiments, the abrasive tool may provide an edge quality of not greater than about 100% of the workpiece free from defects, such as, not greater than about 95%, not greater than about 90% or even not greater than about 75% free of defects. It will be appreciated that the tool may provide an edge quality of any percentage within a range between any of the minimum and maximum values noted above.

In certain embodiments, the abrasive tool may have a specific G-ratio according to the standard high material removal rate glass grinding test. For example, the abrasive tool may have a G-ratio of at least about 40 k, such as, at least about 45 k, at least about 50 k, at least about 55 k, at least about 60 k or even at least about 65 k. In still other embodiments, the abrasive tool may have a G-ratio of not greater than about 70 k, such as, not greater than about 65 k or even not greater than about 60 k. It will be appreciated that the abrasive tool may have a G-ratio of any value within a range between any of the minimum and maximum values noted above.

EXAMPLES

Abrasive articles according to embodiments described herein were formed from a mixture of the components as provided in Table 1.

TABLE 1

| Examples 1 & 2 | | |
|---|---|---|
| Component | Example 1 (Wt. %) | Example 2 (Wt. %) |
| Tungsten (W) | 0 | 0 |
| Titanium Hydride ($TiH_2$) | 10 | 10 |
| Cast Iron (CI) | 55 | 55 |
| Elemental Copper (Cu) | 0 | 28 |
| Elemental Tin (Sn) | 0 | 7 |
| Pre-alloyed Bronze (80/20) | 35 | 0 |
| Nickel (Ni) | 0 | 0 |
| Chromium (Cr) | 0 | 0 |

For Examples 1 and 2, the mixture was formed into an abrasive tool using hot-pressing at a temperature in a range between 850° C. and about 1000° C. and at a pressure in a range between about 1 tons/in$^2$ to about 2 tons/in$^2$.

A convention abrasive article was formed from a mixture of the components as provided in Table 2.

TABLE 2

| Conventional Example | |
|---|---|
| Component | Conventional Example (Wt. %) |
| Tungsten (W) | 65 |
| Titanium Hydride ($TiH_2$) | 0 |
| Cast Iron (CI) | 0 |
| Elemental Copper (Cu) | 0 |
| Elemental Tin (Sn) | 0 |
| Pre-alloyed Bronze (80/20) | 33 |
| Nickel (Ni) | 1 |
| Chromium (Cr) | 1 |

For the conventional example, the mixture was formed into an abrasive tool using hot-pressing at a temperature in a range between 850° C. and about 1000° C. and at a pressure in a range between about 1 tons/in$^2$ to about 2 tons/in$^2$.

Table 3 provides the high material removal rate characteristics of Example 2 and the conventional example.

TABLE 3

| Material Removal Rate Characteristics | | |
|---|---|---|
| Material Removal Rate Characteristics | Example 2 | Conventional Example |
| Break-In Length (linear meters) | 0 | Never Broke-In |
| Speed Character (m/min) | 20 | Never Broke-In |
| Dressing Frequency (parts/dress) | 25 | 1-2 |
| Edge Quality | No Cracking, Microchipping or Burns | High amount of Cracking, Microchipping and Burns |

Table 4 provides a comparison of the average life spans for Example 2 and the conventional example when grinding is performed on glass having a thickness of 6 mm. Testing parameters and certain other material removal rate characteristics are also provided.

TABLE 4

| Comparison Test on 6 mm Glass | | |
|---|---|---|
| | Example 2 | Conventional Example |
| Comparison Test Parameters | | |
| Machine Type | Bystronic | Bystronic |
| Line Speed (m/min) | 30 | 30 |
| Coolant Used | DR | DR |
| Glass Thickness (mm) | 6 | 6 |
| Diamond Concentration | 50 | 40 |
| Feed Rate | Initial Speed - 20 m/min; Ramped to 30 m/min within 56 meter of glass (no sparking) | Initial Speed - 5 m/min No Increase (increasing feed rate caused intense sparking) |
| Comparison Test Material Removal Rate Characteristics | | |
| Average Life Span (Linear Meters Ground) | 54000 | 250 |
| Break-In Length (linear meters) | 0 | Never Broke-In |
| Edge Quality | No Cracking, Microchipping or Burns | High amount of Cracking, Microchipping and Burns (80% of length rejected) |

Table 5 provides a comparison of the average life spans for Example 2 and the conventional example when grinding is performed on tempered glass having a thickness of 3 to 4 mm. Testing parameters are also provided.

TABLE 5

| Comparison Test on 3 to 4 mm Tempered Glass | | |
|---|---|---|
| | Example 2 | Conventional Example |
| Comparison Test Parameters | | |
| Machine Type | Bando | Bando |
| Line Speed (m/min) | 30 | 30 |
| Coolant Used | Ferro | Ferro |
| Glass Thickness (mm) | 6 | 6 |
| Diamond Concentration | 70 | 70 |
| Comparison Test Material Removal Rate Characteristics | | |
| Average Life Span (Linear Meters Ground) | 6617 | 3632 |

Table 6 provides a comparison of the average life spans for Example 2 and the conventional example when grinding is performed on glass having a thickness of 3 to 4 mm. Testing parameters are also provided.

TABLE 6

| Comparison Test on 3 to 4 mm Glass | | |
|---|---|---|
| | Example 2 | Conventional Example |
| Comparison Test Parameters | | |
| Machine Type | Bystronic | Bystronic |
| Line Speed (m/min) | 25 | 20 |
| Coolant Used | Water | Water |
| Glass Thickness (mm) | 3 to 4 | 3 to 4 |
| Diamond Concentration | 70 | 70 |
| Comparison Test Material Removal Rate Characteristics | | |
| Average Life Per Run (Linear Meters Ground) | 8050 | 7348 |

The present application represents a departure from the state of the art. Notably, the embodiments herein demonstrate improved and unexpected performance over conventional abrasive tools. While not wishing to be bound to a particular theory, it is suggested that combination of certain features including designs, processes, materials, and the like may facilitate such improvements. The combination of features can include, but is not limited to, composition of the bond material, the presence of the active bonding agent that may include titanium hydride, the ratio of tungsten to cast iron in the abrasive article, the ratio of copper-containing compositions to cast iron in the abrasive article, the ratio of titanium-containing compositions to cast iron in the abrasive article, the ratio of tungsten carbide to cast iron in the abrasive article, the ratio of tungsten carbide to copper-containing compositions in the abrasive article, the ratio of copper-containing compositions and titanium-containing compositions to cast iron in the abrasive article and combinations of these features. Notably these combinations of features showed improved performance in high speed grinding operations. Specifically, and without wishing to be tied to any particular theory, embodiments of abrasive articles described herein demonstrated improved material removal rate characteristic, such as, increased break-in length, increased maximum initial speed character, increased life span in linear meters of a workpiece ground, increased dressing frequency, and improved edge quality of the workpiece after grinding or a combination thereof.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

Many different aspects and embodiments are possible. Some of these aspects and embodiments are described below. After reading this specification, those skilled in the art will appreciate that these aspects and embodiments are only illustrative and do not limit the scope of the present invention. Embodiments may be in accordance with any one or more of the items as listed below.

Item 1. An abrasive tool comprising a body including abrasive particles comprising a superabrasive material contained within a bond material, an active bonding agent comprising a titanium-containing composition contained within bond material, and at least one of a ratio of tungsten to cast iron [W/CI] of not greater than about 1, a ratio of copper-containing compositions to cast iron [CCC/CI] of not greater than about 1, a ratio of titanium-containing compositions to cast iron [TiCC/CI] of not greater than about 1, a ratio of tungsten carbide to cast iron [WC/CI] of not greater than about 1, a ratio of tungsten carbide to copper-containing compositions [WC/CCC] of not greater than about 1, a ratio of copper-containing compositions and titanium-containing compositions to cast iron [(CCC+TiC)/CI] of not greater than about 1.5, and a combination thereof.

Item 2. A method of forming an abrasive tool comprising, providing a mixture comprising, a bond material, abrasive particles comprising a superabrasive material, an active bonding agent comprising a titanium-containing compositions, and at least one of a ratio of tungsten to cast iron [W/CI] of not greater than about 1, a ratio of copper-containing compositions to cast iron [CCC/CI] of not greater than about 1, a ratio of titanium-containing compositions to cast iron [TiCC/CI] of not greater than about 1, a ratio of tungsten carbide to cast iron [WC/CI] of not greater than about 1, a ratio of tungsten carbide to copper-containing compositions [WC/CCC] of not greater than about 1, a ratio of copper-containing compositions and titanium-containing compositions to cast iron [(CCC+TiC)/CI] of not greater than about 1.5, and a combination thereof and forming the mixture into the abrasive tool.

Item 3. The abrasive tool or method of forming an abrasive tool of any one of items 1 and 2, wherein the ratio of tungsten to cast iron [W/CI] is not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 or not greater than about 0.005, wherein the ratio of tungsten to cast iron [W/CI] is essentially zero.

Item 4. The abrasive tool or method of forming an abrasive tool of any one of items 1 and 2, wherein the ratio of tungsten to cast iron [W/CI] is at least about 0.001, at least about 0.005, at least about 0.01, at least about 0.05, at least about 0.1.

Item 5. The abrasive tool or method of forming an abrasive tool of any one of items 1 and 2, wherein the ratio of copper-containing compositions to cast iron [CCC/CI] is not greater than about 0.9, not greater than about 0.8, not greater than about 0.75, not greater than about 0.7, not greater than about 0.68.

Item 6. The abrasive tool or method of forming an abrasive tool of any one of items 1 and 2, wherein the ratio of copper-containing compositions to cast iron [CCC/CI] is at least about 0.1, at least about 0.2, at least about 0.3, at least about 0.35, at least about 0.4, at least about 0.45, at least about 0.5, at least about 0.55 and at least about 0.6.

Item 7. The abrasive tool or method of forming an abrasive tool of any one of items 1 and 2, wherein the ratio of titanium-containing compositions to cast iron [TiCC/CI] is not greater than about 0.9, not greater than about 0.8, not greater than about 0.7, not greater than about 0.6, not greater than about 0.5, not greater than about 0.4, not greater than about 0.35, not greater than about 0.3, not greater than about 0.28, not greater than about 0.25, not greater than about 0.23 and not greater than about 0.2.

Item 8. The abrasive tool or method of forming an abrasive tool of any one of items 1 and 2, wherein the ratio of titanium-containing compositions to cast iron [TiCC/CI] is at least about 0.01, at least about 0.05, at least about 0.08, at least about 0.1, at least about 0.12, at least about 0.14, at least about 0.16.

Item 9. The abrasive tool or method of forming an abrasive tool of any one of items 1 and 2, wherein the ratio of tungsten carbide to cast iron [WC/CI] is not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.01 wherein the ratio of tungsten carbide to cast iron [WC/CI] is essentially zero.

Item 10. The abrasive tool or method of forming an abrasive tool of any one of items 1 and 2, wherein the ratio of tungsten carbide to cast iron [WC/CI] of at least about 0.01.

Item 11. The abrasive tool or method of forming an abrasive tool of any one of items 1 and 2, wherein the ratio of tungsten carbide to copper-containing compositions [WC/CCC] is not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.01, wherein the ratio of tungsten carbide to copper-containing compositions [WC/CCC] is essentially zero.

Item 12. The abrasive tool or method of forming an abrasive tool of any one of items 1 and 2, wherein the ratio of tungsten carbide to copper-containing compositions [WC/CCC] is at least about 0.001.

Item 13. The abrasive tool or method of forming an abrasive tool of any one of items 1 and 2, wherein the ratio of copper-containing compositions and titanium-containing compositions to cast iron [(CCC+TiCC)/CI] is not greater than about 1.4, not greater than about 1.3, not greater than about 1.2, not greater than about 1, not greater than about 0.98, not greater than about 0.96, not greater than about 0.94, not greater than about 0.92, not greater than about 0.9, not greater than about 0.88, not greater than about 0.86, not greater than about 0.84.

Item 14. The abrasive tool or method of forming an abrasive tool of any one of items 1 and 2, wherein the ratio of copper-containing compositions and titanium-containing compositions to cast iron [(CCC+TiCC)/CI] is at least about 0.1, at least about 0.2, at least about 0.3, at least about 0.4, at least about 0.5, at least about 0.6, at least about 0.7, at least about 0.72, at least about 0.74, at least about 0.76, at least about 0.78, at least about 0.8.

Item 15. The abrasive tool or method of forming an abrasive tool of any one of items 1 and 2, wherein the body further comprises comprising a ratio of nickel to cast iron [Ni/CI] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 and not greater than about 0.005, wherein the body further comprises a ratio of nickel to cast iron [Ni/CI] of essentially zero.

Item 16. The abrasive tool or method of forming an abrasive tool of any one of items 1 and 2, wherein the body further comprises a ratio of nickel to cast iron [Ni/CI] of at least about 0.001.

Item 17. The abrasive tool or method of forming an abrasive tool of any one of items 1 and 2, wherein the body further comprises a ratio of chromium to cast iron [Cr/CI] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 and not greater than about 0.005, wherein the ratio of chromium to cast iron [Cr/CI] is essentially zero.

Item 18. The abrasive tool or method of forming an abrasive tool of any one of items 1 and 2, further comprising a ratio of chromium to cast iron [Cr/CI] of at least about 0.001, at least about 0.005, at least about 0.01, at least about 0.05, at least about 0.1, at least about 0.2, at least about 0.3, at least about 0.4, at least about 0.5, at least about 0.6, at least about 0.7, at least about 0.8 and at least about 0.9.

Item 19. The abrasive tool or method of forming an abrasive tool of any one of items 1 and 2, wherein the body further comprises a ratio of tungsten to copper-containing compositions [W/CCC] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 and not greater than about 0.005, wherein the ratio of tungsten to copper-containing compositions [W/CCC] is essentially zero.

Item 20. The abrasive tool or method of forming an abrasive tool of any one of items 1 and 2, wherein the body further comprises a ratio of tungsten to copper-containing compositions [W/CCC] of at least about 0.001.

Item 21. The abrasive tool or method of forming an abrasive tool of any one of items 1 and 2, wherein the body further comprises a ratio of tungsten to titanium-containing compositions [W/TiCC] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not wherein the ratio of tungsten to titanium-containing compositions [W/TiCC] is essentially zero.

Item 22. The abrasive tool or method of forming an abrasive tool of any one of items 1 and 2, wherein the body further comprises a ratio of tungsten to titanium-containing compositions [W/TiCC] of at least about 0.001.

Item 23. The abrasive tool or method of forming an abrasive tool of any one of items 1 and 2, wherein the body further comprises a ratio of titanium-containing compositions to abrasive particles [TiCC/AP] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 and not greater than about 0.005.

Item 24. The abrasive tool or method of forming an abrasive tool of any one of items 1 and 2, wherein the body further comprises a ratio of titanium-containing compositions to abrasive particles [TiCC/AP] of at least about 0.001, at least about 0.005, at least about 0.01, at least about 0.05, at least about 0.1, at least about 0.2, at least about 0.3, at least about 0.4, at least about 0.5, at least about 0.6, at least about 0.7, at least about 0.8 and at least about 0.9.

Item 25. The abrasive tool or method of forming an abrasive tool of any one of items 1 and 2, wherein the body further comprises a ratio of cast iron to abrasive particles [CI/AP] of not greater than about 1, not greater than about 0.9, not greater than about 0.8, not greater than about 0.7, not greater than about 0.6, not greater than about 0.5, not greater than about 0.4, not greater than about 0.3, not greater than about 0.2, not greater than about 0.1, not greater than about 0.05, not greater than about 0.01 and not greater than about 0.005.

Item 26. The abrasive tool or method of forming an abrasive tool of any one of items 1 and 2, wherein the body further comprises a ratio of cast iron to abrasive particles [CI/AP] of at least about 0.001, at least about 0.005, at least about 0.01, at least about 0.05, at least about 0.1, at least about 0.2, at least about 0.3, at least about 0.4, at least about 0.5, at least about 0.6, at least about 0.7, at least about 0.8 and at least about 0.9.

Item 27. The abrasive tool or method of forming an abrasive tool of any one of items 1 and 2, wherein the superabrasive material comprises a material selected from the group consisting of diamond, cubic boron nitride, and a combination thereof, wherein the superabrasive material consists essentially of diamond, wherein the superabrasive material consists essentially of cubic boron nitride, wherein the superabrasive material comprises a Mohs hardness of at least about 8, at least about 8.5, at least about 9.

Item 28. The abrasive tool or method of forming an abrasive tool of any one of items 1 and 2, wherein the abrasive particles comprise a coefficient of thermal expansion (CTEab) and the bond material comprises a coefficient of thermal expansion (CTEbm), and wherein the absolute value of the difference between the CTEab and CTEbm [|(CTEab-CTEbm)|] is not greater than about 20 m/m/° K, not greater than about 18 m/m/° K, not greater than about 16 m/m/° K, not greater than about 14 m/m/° K, not greater than about 12 m/m/° K, not greater than about 10 m/m/° K, not greater than about 8 m/m/° K, not greater than about 6 m/m/° K, not greater than about 4 m/m/° K and not greater than about 2 m/m/° K.

Item 29. The abrasive tool or method of forming an abrasive tool of any one of items 1 and 2, wherein the abrasive particles comprise a coefficient of thermal expansion (CTEab) and the bond material comprises a coefficient of thermal expansion (CTEbm), and wherein the absolute value of the difference between the CTEab and CTEbm [|(CTEab-CTEbm)|] is at least about 1 m/m/° K, at least about 2 m/m/° K, at least about 4 m/m/° K, at least about 6 m/m/° K, at least about 8 m/m/° K, at least about 10 m/m/° K, at least about 12 m/m/° K, at least about 14 m/m/° K, at least about 16 m/m/° K and at least about 18 m/m/° K.

Item 30. The abrasive tool or method of forming an abrasive tool of any one of items 1 and 2, wherein the copper-containing composition comprises a melting point (CCCmp) and the cast iron comprises a melting point (CImp), and wherein the absolute value of the difference between the CCCmp and the CImp [|CCCmp-CImp|] is not greater than about 1000° C., not greater than about 500° C., not greater than about 250° C., not greater than about 100° C., not greater than about 80° C., not greater than about 70° C., not greater than about 60° C., not greater than about 50° C., not greater than about 40° C., not greater than about 30° C., not greater than about 20° C., not greater than about 10° C. and not greater than about 5° C.

Item 31. The abrasive tool or method of forming an abrasive tool of any one of items 1 and 2, wherein the copper-containing composition comprises a melting point (CCCmp) and the cast iron comprises a melting point (CImp), and wherein the absolute value of the difference between the CCCmp and the CImp [|CCCmp-CImp|] is at least about 1° C., at least about 10° C., at least about 20° C., at least about 30° C., at least about 40° C., at least about 50° C., at least about 60° C., at least about 70° C., at least about 80° C., at least about 90° C., at least about 100° C., at least about 250° C., at least about 500° C. and at least about 990° C.

Item 32. The abrasive tool or method of forming an abrasive tool of any one of items 1 and 2, wherein the bond material comprises a copper-containing composition having a melting temperature of not greater than about 1000° C., not greater than about 950° C., not greater than about 900° C., not greater than about 850° C., not greater than about 800° C., not greater than about 750° C., not greater than about 700° C., not greater than about 650° C., not greater than about 600° C., not greater than about 550° C., not greater than about 500° C., not greater than about 450° C. and not greater than about 410° C.

Item 33. The abrasive tool or method of forming an abrasive tool of any one of items 1 and 2, wherein the bond material comprises cast iron having an average particle size [D50] of not greater than about 300 microns, not greater than about 250 microns, not greater than about 200 microns, not greater than about 150 microns, not greater than about 100 microns, not greater than about 90 microns, not greater than about 80 microns, not greater than about 70 microns, not greater than about 60 microns, not greater than about 50 microns, not greater than about 40 microns, not greater than about 30 microns, not greater than about 20 microns, not greater than about 10 microns, not greater than about 5 microns or not greater than about 2 microns.

Item 34. The abrasive tool or method of forming an abrasive tool of any one of items 1 and 2, wherein the bond material comprises cast iron having an average particle size [D50] of at least about 1 micron, at least about 5 microns, at least about 10 microns, at least about 20 microns, at least about 30 microns, at least about 40 microns, at least about 50 microns, at least about 60 microns, at least about 70 microns, at least about 80 microns, at least about 90 microns, at least about 100 microns, at least about 150 microns, at least about 200 microns, at least about 250 microns and at least about 290 microns.

Item 35. The abrasive tool or method of forming an abrasive tool of any one of items 1 and 2, wherein the bond material comprises cast iron particles defining a particle size distribution, and wherein the particle size distribution is a Gaussian distribution, wherein the particle size distribution is a multi-modal distribution, wherein the particle size distribution is a bi-modal distribution including a first mode defining a coarse particle size and a second mode defining a fine particle size.

Item 36. The abrasive tool or method of forming an abrasive tool of any one of items 1 and 2, wherein the body comprises a first titanium-containing composition preferentially located adjacent to the cast iron and a second titanium-containing composition preferentially located adjacent to the abrasive particles.

Item 37. The abrasive tool or method of forming an abrasive tool of item 36, wherein the first titanium-containing composition comprises a titanium-tin alloy and the second titanium-containing composition comprises titanium carbide.

Item 38. The abrasive tool or method of forming an abrasive tool of item 36, wherein the body comprises a content of the first titanium-containing composition (TCC1) and a content of the second titanium-containing composition (TCC2), wherein the content of the first titanium-containing composition is greater than the content of the second titanium-containing composition.

Item 39. The abrasive tool or method of forming an abrasive tool of item 36, wherein the body comprises a ratio (TCC1/TCC2) of the first titanium-containing composition (TCC1) to the second titanium-containing composition (TCC2) of not greater than about 2, not greater than about 1.8, not greater than about 1.6, not greater than about 1.4, not greater than about 1.4, not greater than about 1.2, not greater than about 1.0, not greater than about 0.8, not greater than about 0.6, not greater than about 0.4 and not greater than about 0.2.

Item 40. The abrasive tool or method of forming an abrasive tool of item 36, wherein the body comprises a ratio (TCC1/TCC2) of the first titanium-containing composition (TCC1) to the second titanium-containing composition (TCC2) of at least about 0.1, at least about 0.2, at least about 0.4, at least about 0.6, at least about 0.8, at least about 1.0, at least about 1.2, at least about 1.4, at least about 1.6, at least about 1.8 and at least about 1.9.

Item 41. The abrasive tool or method of forming an abrasive tool of any one of items 1 and 2, wherein the body comprises not greater than about 10 wt. % titanium-containing compositions for a total weight of the bond material, not greater than about 9 wt. %, not greater than about 8 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. % and not greater than about 1 wt. %.

Item 42. The abrasive tool or method of forming an abrasive tool of any one of items 1 and 2, wherein the body comprises at least about 1 wt. % titanium-containing compositions for a total weight of the bond material, at least about 2 wt. %, at least about 3 wt. %, at least about 4 wt. %, at least about 5 wt. %, at least about 6 wt. %, at least about 7 wt. %, at least about 8 wt. %, at least about 9 wt. %, at least about 10 wt. %.

Item 43. The abrasive tool or method of forming an abrasive tool of any one of items 1 and 2, wherein the body comprises not greater than about 10 wt. % tungsten for a total weight of the bond material, not greater than about 9 wt. %, not greater than about 8 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. % and not greater than about 1 wt. %, wherein the bond material is essentially free of tungsten.

Item 44. The abrasive tool or method of forming an abrasive tool of any one of items 1 and 2, wherein the body comprises at least about 0.1 wt. % tungsten for the total weight of the bond material, at least about 1 wt. % and at least about 5 wt. %.

Item 45. The abrasive tool or method of forming an abrasive tool of any one of items 1 and 2, wherein the body comprises not greater than about 50 wt. % copper-containing compound for a total weight of the bond material, not greater than about 45 wt. %, not greater than about 35 wt. %, not greater than about 30 wt. %, not greater than about 25 wt. %, not greater than about 20 wt. % and not greater than about 15 wt. %.

Item 46. The abrasive tool or method of forming an abrasive tool of any one of items 1 and 2, wherein the body comprises at least about 10 wt. % copper-containing compound for a total weight of the bond material, at least about 15 wt. %, at least about 20 wt. %, at least about 25 wt. %, at least about 30 wt. %, at least about 35 wt. %, at least about 40 wt. %, at least about 45 wt. % and at least about 50 wt. %.

Item 47. The abrasive tool or method of forming an abrasive tool of any one of items 1 and 2, wherein the copper-containing compound comprises pre-alloyed bronze.

Item 48. The abrasive tool or method of forming an abrasive tool of item 47, wherein the pre-alloyed bronze comprises not greater than about 65 wt. % tin for a total weight of the pre-alloyed bronze, not greater than about 60 wt. %, not greater than about 55 wt. %, not greater than about 50 wt. %, not greater than about 45 wt. %, not greater than about 40 wt. %, and at least about 10 wt. %, at least about 20 wt. %, at least about 30 wt. %.

Item 49. The abrasive tool or method of forming an abrasive tool of item 47, wherein the pre-alloyed bronze comprises a content of copper that is not less than a content of tin.

Item 50. The abrasive tool or method of forming an abrasive tool of item 47, wherein the pre-alloyed bronze comprises a content of copper that is greater than a content of tin.

Item 51. The abrasive tool or method of forming an abrasive tool of item 47, wherein the pre-alloyed bronze comprises at least about 10 wt. % copper for a total weight of the pre-alloyed bronze, at least about 20 wt. %, at least about 30 wt. %, at least about 40 wt. %, at least about 45 wt. %, at least about 50 wt. %, at least about 55 wt. %, at least about 60 wt. %, at least about 65 wt. %, at least about 70 wt. %, at least about 75 wt. %, at least about 80 wt. %, at least about 85 wt. %, at least about 90 wt. % and at least about 95 wt. %.

Item 52. The abrasive tool or method of forming an abrasive tool of item 47, wherein the pre-alloyed bronze comprises not greater than about 90 wt. % copper for a total weight of the pre-alloyed bronze, not greater than about 80 wt. %, not greater than about 70 wt. %, not greater than about 60 wt. %, not greater than about 55 wt. %, not greater than about 50 wt. %.

Item 53. The abrasive tool or method of forming an abrasive tool of any one of items 1 and 2, wherein the body comprises not greater than about 50 wt. % pre-alloyed bronze for a total weight of the bond material, not greater than about 45 wt. %, not greater than about 35 wt. %, not greater than about 30 wt. %, not greater than about 25 wt. %, not greater than about 20 wt. % and not greater than about 15 wt. %.

Item 54. The abrasive tool or method of forming an abrasive tool of any one of items 1 and 2, wherein the body comprises at least about 10 wt. % pre-alloyed bronze for a total weight of the bond material, at least about 15 wt. %, at least about 20 wt. %, at least about 25 wt. %, at least about 30 wt. %, at least about 35 wt. %, at least about 40 wt. %, at least about 45 wt. % and at least about 50 wt. %.

Item 55. The abrasive tool or method of forming an abrasive tool of any one of items 1 and 2, wherein the copper-containing compound comprises elemental copper.

Item 56. The abrasive tool or method of forming an abrasive tool of any one of items 1 and 2, wherein the body comprises not greater than about 50 wt. % elemental copper for a total weight of the bond material, not greater than about 45 wt. %, not greater than about 35 wt. %, not greater than about 30 wt. %, not greater than about 25 wt. %, not greater than about 20 wt. % and not greater than about 15 wt. %.

Item 57. The abrasive tool or method of forming an abrasive tool of any one of items 1 and 2, wherein the body comprises at least about 10 wt. % elemental copper for a total weight of the bond material, at least about 15 wt. %, at least about 20 wt. %, at least about 25 wt. %, at least about 30 wt. %, at least about 35 wt. %, at least about 40 wt. %, at least about 45 wt. % and at least about 50 wt. %.

Item 58. The abrasive tool or method of forming an abrasive tool of any one of items 1 and 2, wherein the body comprises not greater than about 20 wt. % tin for a total weight of the bond material, not greater than about 15 wt. %, not greater than about 10 wt. %, not greater than about 9 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. % and not greater than about 1 wt. %.

Item 59. The abrasive tool or method of forming an abrasive tool of any one of items 1 and 2, wherein the body comprises at least about 0.5 wt. % tin for a total weight of the bond material, at least about 1.0 wt. %, at least about 2.0 wt. %, at least about 3 wt. %, at least about 4 wt. %, at least about 5 wt. %, at least about 6 wt. %, at least about 7 wt. %, at least about 8 wt. %, at least about 9 wt. %, at least about 10 wt. %, at least about 15 wt. % and at least about 19 wt. %.

Item 60. The abrasive tool or method of forming an abrasive tool of any one of items 1 and 2, wherein the body comprises not greater than about 75 wt. % cast iron for a total weight of the bond material, not greater than about 70 wt. %, not greater than about 65 wt. %, not greater than about 60 wt. %, not greater than about 55 wt. %, not greater than about 50 wt. %, not greater than about 45 wt. %, not greater than about 40 wt. % and not greater than about 35 wt. %.

Item 61. The abrasive tool or method of forming an abrasive tool of any one of items 1 and 2, wherein the body comprises at least about 10 wt. % cast iron for the total weight of the bond material, at least about 15 wt. %, at least about 20 wt. %, at least about 25 wt. %, at least about 35 wt. %, at least about 40 wt. %, at least about 45 wt. %, at least about 50 wt. %, at least about 55 wt. %, at least about 60 wt. %, at least about 65 wt. % and at least about 70 wt. %.

Item 62. The abrasive tool or method of forming an abrasive tool of any one of items 1 and 2, wherein the cast iron comprises not greater than about 5 wt. % carbon for a total weight of the cast iron, not greater than about 4.5 wt. %, not greater than about 4.0 wt. %, not greater than about 3.5 wt. %, not greater than about 3.0 wt. %, not greater than about 2.5 wt. %, not greater than about 2.0 wt. %, not greater than about 1.5 wt. %, not greater than about 1.0 wt. % and not greater than about 0.5 wt. %.

Item 63. The abrasive tool or method of forming an abrasive tool of any one of items 1 and 2, wherein the cast iron comprises about 0.5 wt. % carbon for a total weight of the cast iron, at least about 1.0 wt. %, at least about 1.5 wt. %, at least about 2.0 wt. %, at least about 2.5 wt. %, at least about 3.0 wt. %, at least about 3.5 wt. %, at least about 4.0 wt. %, at least about 4.5 wt. % and at least about 4.9 wt. %.

Item 64. The abrasive tool or method of forming an abrasive tool of any one of items 1 and 2, wherein the cast iron comprises not greater than about 5 wt. % chromium for a total weight of the cast iron, not greater than about 4.5 wt. %, not greater than about 4.0 wt. %, not greater than about 3.5 wt. %, not greater than about 3.0 wt. %, not greater than about 2.5 wt. %, not greater than about 2.0 wt. %, not greater than about 1.5 wt. %, not greater than about 1.0 wt. % and not greater than about 0.5 wt. %.

Item 65. The abrasive tool or method of forming an abrasive tool of any one of items 1 and 2, wherein the cast iron comprises at least about 0.5 wt. % chromium for a total weight of the cast iron, at least about 1.0 wt. %, at least about 1.5 wt. %, at least about 2.0 wt. %, at least about 2.5 wt. %, at least about 3.0 wt. %, at least about 3.5 wt. %, at least about 4.0 wt. %, at least about 4.5 wt. %, and at least about 4.9 wt. %.

Item 66. The abrasive tool or method of forming an abrasive tool of any one of items 1 and 2, wherein the body comprises not greater than about 10 wt. % chromium for the total weight of the bond material, not greater than about 9 wt. %, not greater than about 8 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, and not greater than about 1 wt. %, wherein the bond material is essentially free of chromium.

Item 67. The abrasive tool or method of forming an abrasive tool of any one of items 1 and 2, wherein the body comprises at least about 0.1 wt. % chromium for the total weight of the bond material, at least about 1 wt. %, and at least about 5 wt. %.

Item 68. The abrasive tool or method of forming an abrasive tool of any one of items 1 and 2, wherein the body comprises not greater than about 10 wt. % nickel for the total weight of the bond material, not greater than about 9 wt. %, not greater than about 8 wt. %, not greater than about 8 wt. %, not greater than about 7 wt. %, not greater than about 6 wt. %, not greater than about 5 wt. %, not greater than about 4 wt. %, not greater than about 3 wt. %, not greater than about 2 wt. %, and not greater than about 1 wt. %, wherein the bond material is essentially free of nickel.

Item 69. The abrasive tool or method of forming an abrasive tool of any one of items 1 and 2, wherein the body comprises at least about 0.1 wt. % nickel for the total weight of the bond material, at least about 1 wt. %, and at least about 5 wt. %.

What is claimed is:

1. An abrasive tool comprising:

a body including:

abrasive particles comprising a superabrasive material contained within a bond material;

an active bonding agent comprising a titanium-containing composition contained within the bond material;

at least about 25 wt. % cast iron for a total weight of the bond material; and at least one of:

a ratio of tungsten to cast iron [W/CI] of not greater than about 1;

a ratio of copper-containing compositions to cast iron [CCC/CI] of not greater than about 1;

a ratio of titanium-containing compositions to cast iron [TiCC/CI] of not greater than about 1;

a ratio of tungsten carbide to cast iron [WC/CI] of not greater than about 1;

a ratio of tungsten carbide to copper-containing compositions [WC/CCC] of not greater than about 1;

a ratio of copper-containing compositions and titanium-containing compositions to cast iron [(CCC+TiC)/CI] of not greater than about 1.5; and a combination thereof.

2. The abrasive tool of claim 1, wherein the body further comprises comprising a ratio of nickel to cast iron [Ni/CI] of not greater than about 1.

3. The abrasive tool of any one of claim 1, wherein the body further comprises a ratio of chromium to cast iron [Cr/CI] of not greater than about 1.

4. The abrasive tool of any one of claim 1, wherein the body further comprises a ratio of titanium-containing compositions to abrasive particles [TiCC/AP] of not greater than about 1.

5. The abrasive tool of claim 1, wherein the body further comprises a ratio of cast iron to abrasive particles [CI/AP] of not greater than about 1.

6. The abrasive tool of any one of claim 1, wherein the body comprises a first titanium-containing composition preferentially located adjacent to the cast iron and a second titanium-containing composition preferentially located adjacent to the abrasive particles.

7. The abrasive tool of claim 1, wherein the body comprises not greater than about 10 wt. % titanium-containing compositions for a total weight of the bond material.

8. The abrasive tool of any one of claim 1, wherein the body comprises not greater than about 10 wt. % tungsten for a total weight of the bond material.

9. The abrasive tool of claim 1, wherein the body comprises not greater than about 50 wt. % copper-containing compound for a total weight of the bond material.

10. The abrasive tool of claim 1, wherein the copper-containing compound comprises elemental copper.

11. The abrasive tool of claim 1, wherein the body comprises not greater than about 50 wt. % elemental copper for a total weight of the bond material.

12. The abrasive tool of claim 1, wherein the body comprises not greater than about 20 wt. % tin for a total weight of the bond material.

13. The abrasive tool of claim 1, wherein the cast iron comprises not greater than about 5 wt. % chromium for a total weight of the cast iron.

14. The abrasive tool of claim 1, wherein the body comprises not greater than about 10 wt. % chromium for the total weight of the bond material.

15. A method of forming an abrasive tool comprising:

providing a mixture comprising:

a bond material;

abrasive particles comprising a superabrasive material;

an active bonding agent comprising a titanium-containing compositions;

at least about 25 wt. % cast iron for a total weight of the bond material; and at least one of:

a ratio of tungsten to cast iron [W/CI] of not greater than about 1;

a ratio of copper-containing compositions to cast iron [CCC/CI] of not greater than about 1;

a ratio of titanium-containing compositions to cast iron [TiCC/CI] of not greater than about 1;

a ratio of tungsten carbide to cast iron [WC/CI] of not greater than about 1;

a ratio of tungsten carbide to copper-containing compositions [WC/CCC] of not greater than about 1;

a ratio of copper-containing compositions and titanium-containing compositions to cast iron [(CCC+TiC)/CI] of not greater than about 1.5; and a combination thereof; and forming the mixture into the abrasive tool.

16. The method of forming an abrasive tool of claim 15, wherein the body further comprises a ratio of titanium-containing compositions to abrasive particles [TiCC/AP] of not greater than about 1.

17. The method of forming an abrasive tool of claim 15, wherein the body further comprises a ratio of cast iron to abrasive particles [CI/AP] of not greater than about 1.

18. The method of forming an abrasive tool of claim 15, wherein the body comprises a first titanium-containing composition preferentially located adjacent to the cast iron and a second titanium-containing composition preferentially located adjacent to the abrasive particles.

19. The method of forming an abrasive tool of claim 15, wherein the copper-containing compound comprises elemental copper.

20. The method of forming an abrasive tool of claim 15, wherein the cast iron comprises not greater than about 5 wt. % chromium for a total weight of the cast iron.

* * * * *